US007712240B2

(12) United States Patent
Gipson

(10) Patent No.: US 7,712,240 B2
(45) Date of Patent: May 11, 2010

(54) ANGULAR CORNER STRUCTURE THAT JOIN UNIVERSAL FOLDABLE FRAME MOULDING LENGTHS

(75) Inventor: Jerome Gipson, Vancouver (CA)

(73) Assignees: Ian Gipson, Vancouver, B.C. (CA); David Gipson, Vancouver, B.C. (CA)

( * ) Notice: Subject to any disclaimer, the term of this patent is extended or adjusted under 35 U.S.C. 154(b) by 65 days.

(21) Appl. No.: 12/229,497

(22) Filed: Aug. 25, 2008

(65) Prior Publication Data

US 2010/0043269 A1 Feb. 25, 2010

(51) Int. Cl.
*G09F 1/12* (2006.01)

(52) U.S. Cl. ..... 40/783; 40/782; 40/780; 40/789; 40/786; 40/788

(58) Field of Classification Search ..... 40/780, 40/739, 754, 755, 756, 782, 783, 786, 610, 40/789, 788, 124.09, 493
See application file for complete search history.

(56) References Cited

U.S. PATENT DOCUMENTS

| | | | | | |
|---|---|---|---|---|---|
| 2,250,491 | A | * | 7/1941 | Lurrain | 40/781 |
| 2,581,733 | A | * | 1/1952 | Trask | 40/786 |
| 3,394,479 | A | * | 7/1968 | Siegler | 40/786 |
| 3,765,598 | A | * | 10/1973 | Rosenburg, Jr. | 229/168 |
| 4,479,318 | A | * | 10/1984 | Russell | 40/788 |

* cited by examiner

*Primary Examiner*—Lesley Morris
*Assistant Examiner*—Shin Kim

(57) ABSTRACT

Do-It-Yourself angular corner structures that join universal foldable frame moulding lengths, by use of hand pressure, to create triangular, rectangular and other polygon shaped custom picture frames or custom float frames or protective covers, which are made permanent using adhesive or solvent, without the need for metallic attachment devices.

3 Claims, 7 Drawing Sheets

ANGULAR CORNER STRUCTURE THAT JOIN UNIVERSAL FOLDABLE FRAME MOULDING LENGTHS

REFERENCES CITED

U.S. Patent Documents

| | | | |
|---|---|---|---|
| 11/281,992 | November 2005 | Gipson | 40/700 |
| 4,662,092 | May 1987 | Kim | 40/155 |
| 4,477,990 | October 1984 | Buchanan | 40/155 |

BACKGROUND OF INVENTION

Wood and composite frame mouldings are most commonly cut or severed at angle and joined by use of a holding device, such as a corner vise, while nails or staples and glues are applied to create a permanent join between lengths or segments. Metal mouldings are more commonly miter cut at 45° and joined using 90° metal corner connecting devices that generally fit within a hidden channel at the middle or back thereof and screws are generally applied to secure the join. Plastic mouldings are generally cut at angle and joined using solvent for permanent joins or are compression fit around the perimeter edges of the framing components thereby forming temporary joins between the individual segments. Some frames are made from a continuous length moulding where angles are 90° V-notch cut and the moulding may or may not be severed into individual segments.

SUMMARY OF THE INVENTION

The ends of picture frame mouldings are generally factory cut perpendicular at 90° which is defined herein as factory end(s) and custom miter cut, by a framer, which can be costly, leaving ready-made frames which are made in standard sizes such as 8"×10", 16"×20", and etc. as the only option, which is not acceptable to many artists.

U.S. patent application Ser. No. 11/281,992 introduced a new type of foldable picture frame moulding for the creation of custom picture frames from a continuous length using V-notched cuts in the moulding lip body, by non-framers, to make polygon shaped picture frames. It calls for the use of scissors or a blade, which easily repeats factory end cuts, but to cut mitered corners, the process requires too much time, work, and practice to become proficient. Users require a faster, simpler, and easier solution for making acceptable mitered corners when using this new type of moulding.

OBJECT OF INVENTION

Therefore the object of the present invention is to provide a simpler solution to these problems by using pre-formed angular corner structures to make the frame corners and reduce the amount of time and work needed to complete finished picture frames and provide convertibility and customization.

FIELD OF THE INVENTION

The present invention provides a new and non-obvious solution to these problems by eliminating the need to V-notch or miter cut the factory ends by using angular corner structures. The angular corner structure provides two hollow perpendicular sleeves or slots or openings and is defined herein as sleeve(s), which receives the factory ends into pre-formed polygon angles commonly found in picture framing structures. The sleeve of the angular corner structure holds the factory end in a temporarily assembled joint by use of friction force pressure applied by hand and is made permanent by the application of a suitable adhesive or solvent thereby eliminating the need for metallic attachment devices.

The temporarily assembled joints permit a completed frame assembly to be dismantled quickly and easily by the force of pulling it apart, by hand. The sleeve conforms to and surrounds the entire lip body and a portion of an integral perpendicular side wall body of the factory end it receives which allows the depth/height of both the moulding and the side wall body of the angular corner structure to be easily adjusted using scissors or a blade and/or is cold bent using ones hands.

Each sleeve is terminated by an integral abutment or stop for the factory end and the abutment or stop continues to the vertex corner. The body of the angular corner structure is made using the same resilient copolymer as the moulding described in 11/281,992 and the wall thickness of the angular corner structure is 0.040" which is the same thickness as the moulding. The sleeve of the angular corner structure is marginally larger than the structural body thickness of the moulding. The abutment or stop is 0.045" and is the same thickness as the sleeve.

The interior surfaces of the angular corner structure provide a natural rabbet or stop or recess or shelf that is common to picture frame moulding and is required to receive picture framing components such as glazing, mat boards, spacers, art objects, backing boards, easel backs, and etc. The surfaces of the angular corner structure may be adorned or customized by the user with an assortment of design elements using an assortment of color treatments, tools, and techniques, including painting or decaling or the simulated miter cuts in the lip face at the vertex of the angular corner structure and the score lines cut into the side wall bodies, as shown in the drawings. The side wall body surfaces may include a plurality of thickness reduced score lines or grooves cut parallel to the perpendicular intersection between the integral lip body and side wall body and are similar to those cut in the moulding which provide assistance to the user when cutting or cold-bending straight lines and to adjust the depth/height of the side wall bodies.

BRIEF DESCRIPTION OF THE DRAWINGS

In the following drawings, which form part of the specification of the present invention, and will be better understood from viewing the following detailed description when combined with the drawings, where.

DETAILED DESCRIPTION OF THE PREFERRED EMBODIMENT

Figure 1:
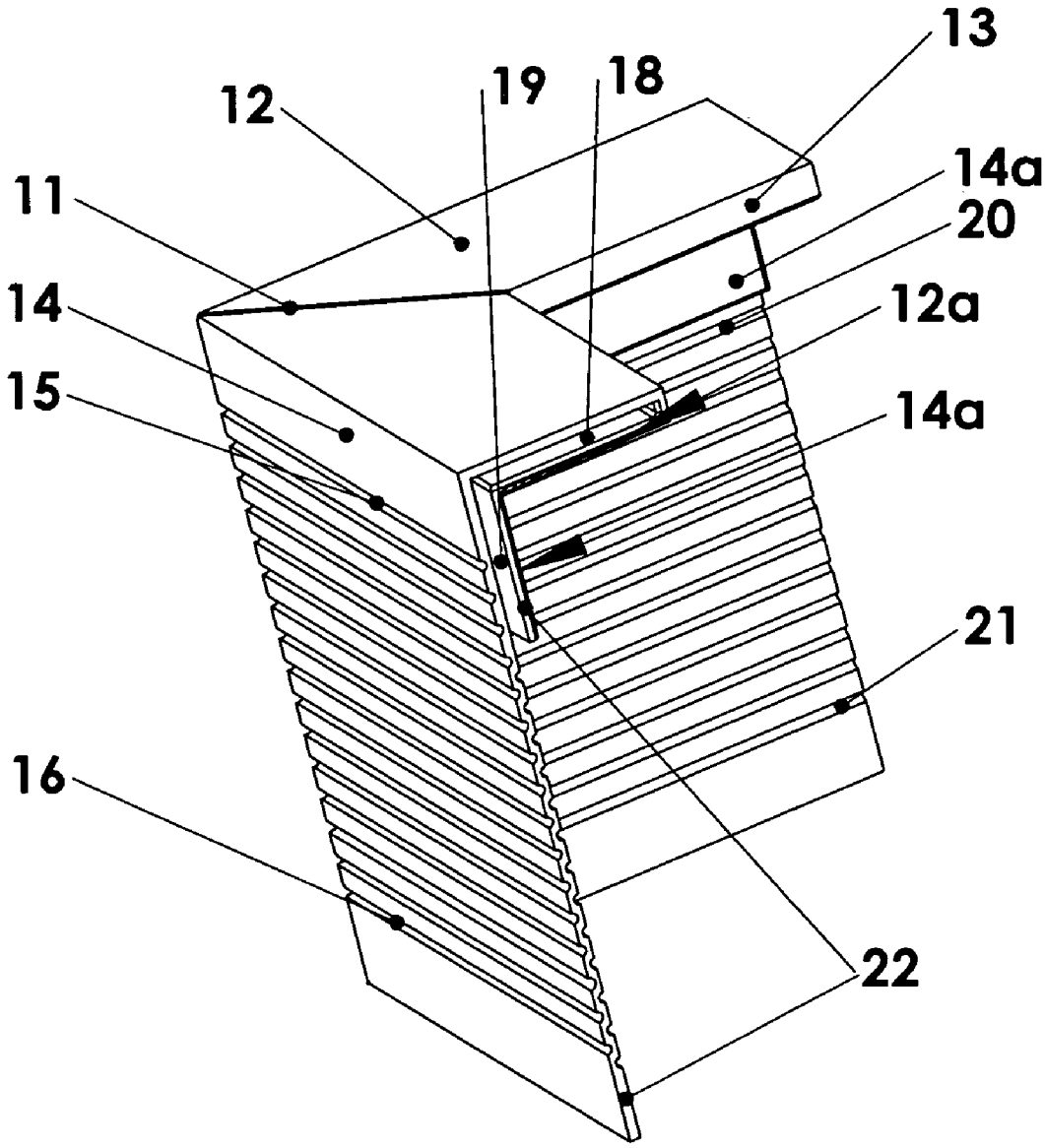
FIG. 1 is a top isometric view of the detailed 90° rectangular corner structure.

FIG. 1 shows a preferred detailed embodiment of the invention which is a 90° angle for the creation of rectangular picture frames where 12 shows an exterior lip body surface which is adorned with a simulated miter cut embossed design element 11 and shows an integral perpendicular lip edge body 13 in perpendicular intersection with an inner lip body 12*a* which is in perpendicular intersection with an inner side wall body 14*a* and 12 is in perpendicular intersection with an integral exterior side wall body 14 which show a plurality of functional thickness reduced score line or groove design elements 15 through 16. The structural body wall thickness 22 is 0.040" which is common to all wall bodies. A tightly formed sleeve 19 located between the side wall bodies are in perpendicular intersection with a sleeve opening between the exterior and inner lip bodies 18, is 0.045" and is bordered by lip edge body 13. Functional thickness reduced score line or groove elements 20 through 21 on the interior wall body combined with 15 through 16 on exterior side wall body 14 make it easy for users to follow straight score lines when cutting or making straight line cold-bends to adjust the depth/height of the side wall body 14. The interior thickness reduced score lines or grooves 20 through 21 are placed in an off-set position from those on the exterior 15 through 16 in an equidistantly spaced pattern.

Figure 2:
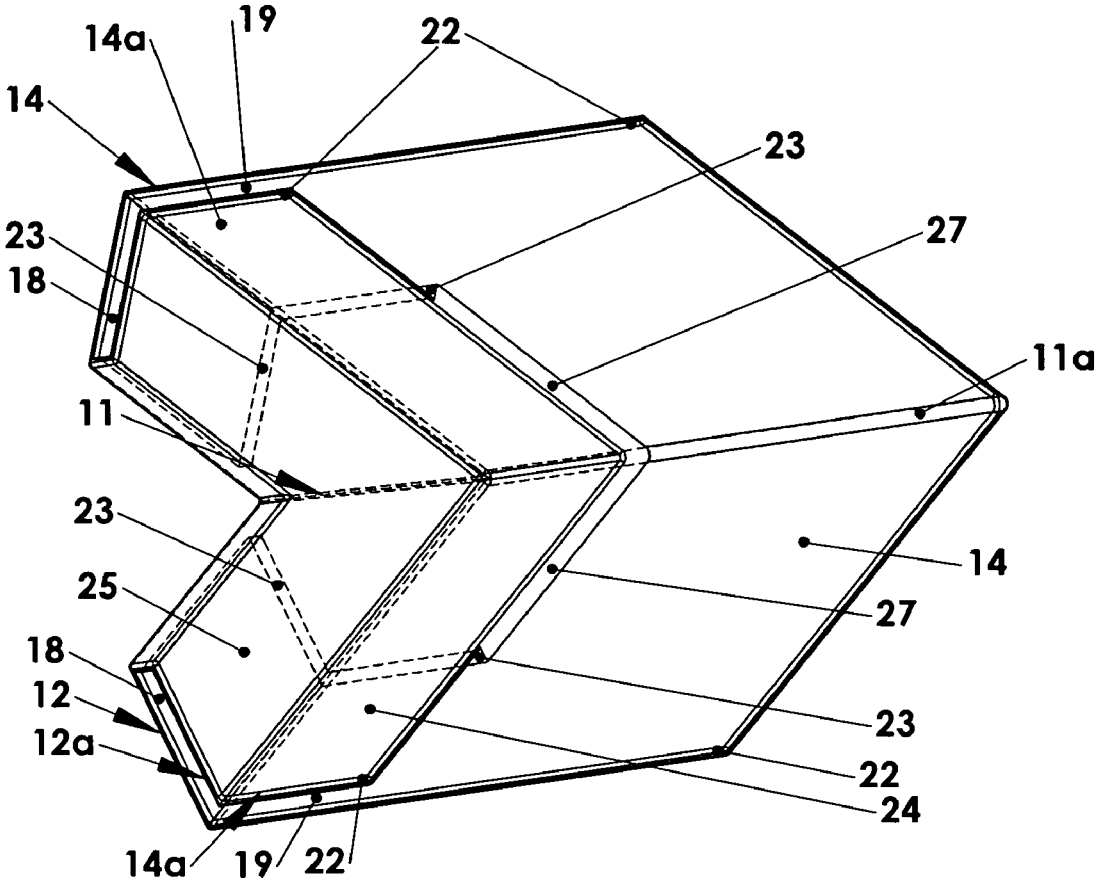
FIG. 2 is an interior isometric view of a 60° triangular corner structure.

FIG. 2 shows an interior view of a triangular corner structure highlighting the inner lip surface 25 in perpendicular intersection with interior wall surface 24 and form the interior rabbet or recess or shelf to stop and hold picture framing components. The sleeves 18 and 19 are terminated by an abutment or stop 23 which continue through 27 to the vertex corner 11*a*. Each lip body, sleeve, side wall body, and other elements on each side of 11 or 11*a* are identically duplicated on the adjoining integral vertex angular body including the lip body, sleeve, side wall body, and other elements in all embodiments of the invention. Sleeve 18 and 19 are the same thickness as the abutment or stop 23 and 27.

Figure 3:
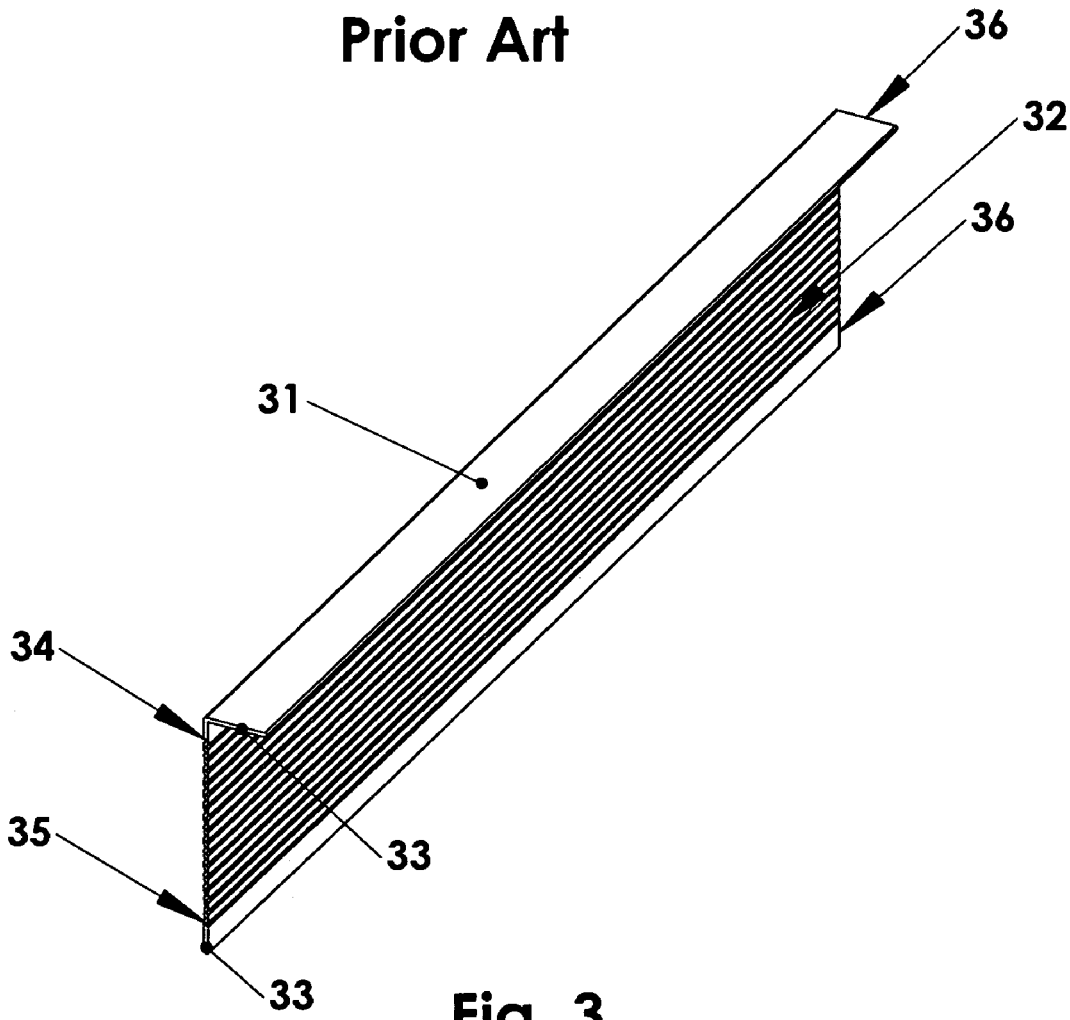
FIG. 3 is a top isometric view of prior art U.S. patent application Ser. No. 11/281,992.

FIG. 3 shows prior art, Universal Foldable Frame Moulding, as described in 11/281,992, where a custom length is shown having two factory ends 33 and 36. Lip body 31 is normally notch cut using scissors or a blade and side wall body 32 is generally cold-bent perpendicularly to the vertex of a finished notched cut to form an angular side wall corner. The user selectable thickness reduced score lines or grooves 34 through 35 are normally cold-bent or creased horizontally to surround and encapsulate the rear perimeter edges of picture framing components. Factory ends 33 and 36 are pressed into the sleeves in a tight alignment and are held in position temporarily by friction force pressure or made permanent by application of adhesive or solvent, as an alternative to notch cutting to create angular corners.

Figure 4:
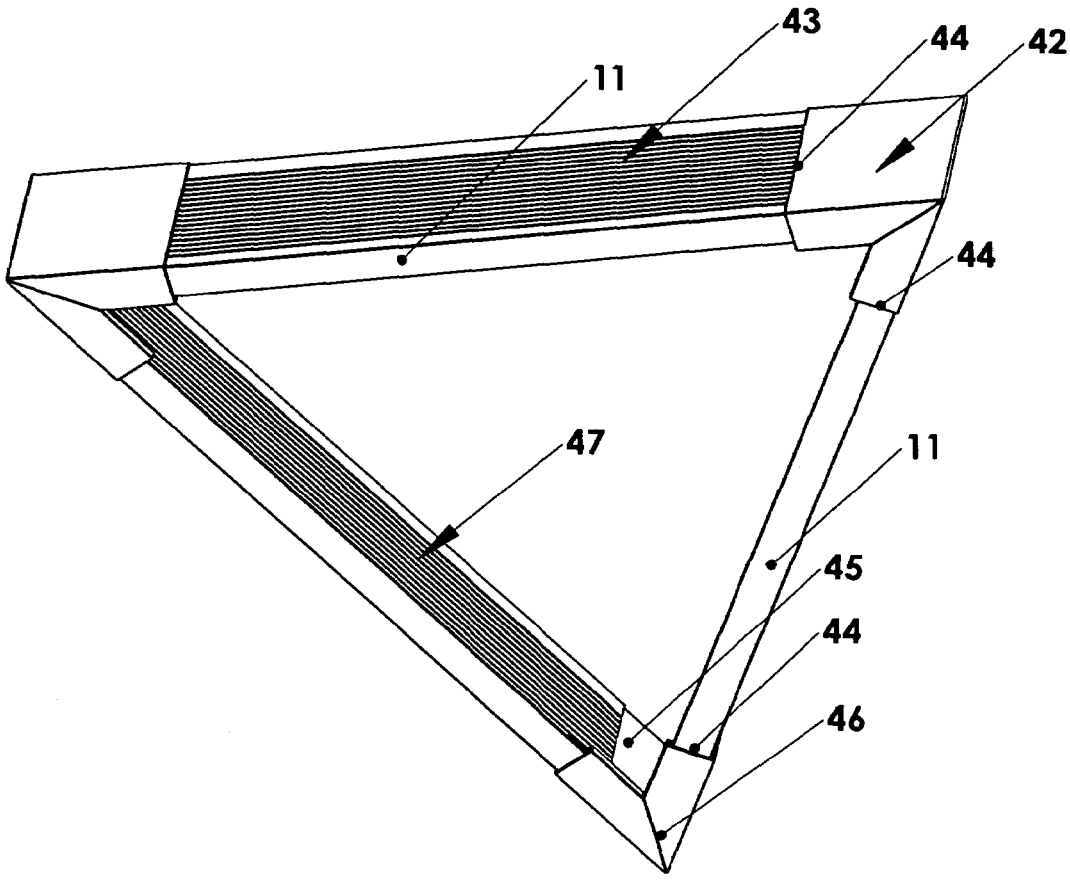
FIG. 4 is an isometric view of FIG. 2 and FIG. 3 joined in a preferred embodiment.

FIG. 4 shows the front view of an empty triangular picture frame created by the joining of three equal individual lengths of prior art FIG. 3 where 33 and 36 have been pressed into three individual 60° triangular corner structures at 44 and thereby forming an equilateral triangular picture frame. 46 shows a simulated miter cut design element embossed in the lip body 12 with 44 showing lip body 11 pressed into sleeve 18. Exterior moulding body 43 and interior moulding body 47 as well as interior side wall body 45 and exterior side wall body 42 of the angular corner structure are unaltered but may be cut or cold-bent or creased inwardly at the rear of an art object and/or picture framing components after these components are inserted into the equilateral triangular picture frame with the art image showing through the front. Score line or groove elements 15 through 16 and 20 through 21 are not shown in this drawing.

Figure 5:
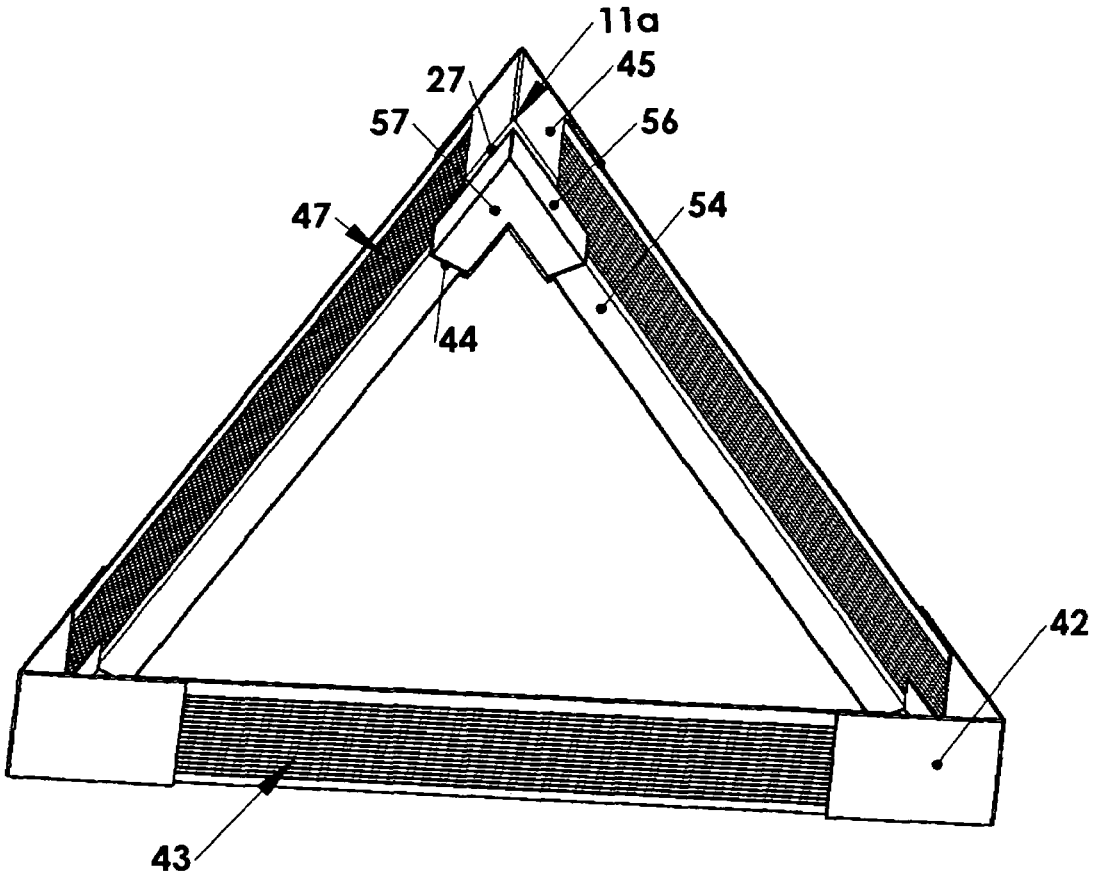
FIG. 5 is a rear isometric view of FIG. 4.

FIG. 5 shows the rear view of FIG. 4. In a case where the art object is a canvas stretched over wooden stretcher bars (not shown), the assembled frame will convert to create a float frame wherein the inner surfaces 54, 56, 47, and 57 which create the rabbet or recess and shelf are attached to the rear of the wooden stretcher bars and 42 and 43 serve to protect the side walls of the stretched canvas and are not cold-bent but left unaltered where no portion of the moulding or angular corner structure covers any part of the image on the canvas while still providing decoration and protection for the perimeter edges of the stretched canvas. The wall body thicknesses of 27 and 56 provide extra strength and protection for the corners of the art object or picture framing components, which are often damaged during transportation, by the inherent off-setting of 45 and 47 from the side walls of the canvas or picture framing components by the thickness of 14 and 27. The depth/height of 42 and 43 is optionally reduced by trimming with a blade or scissors as desired.

Figure 6:
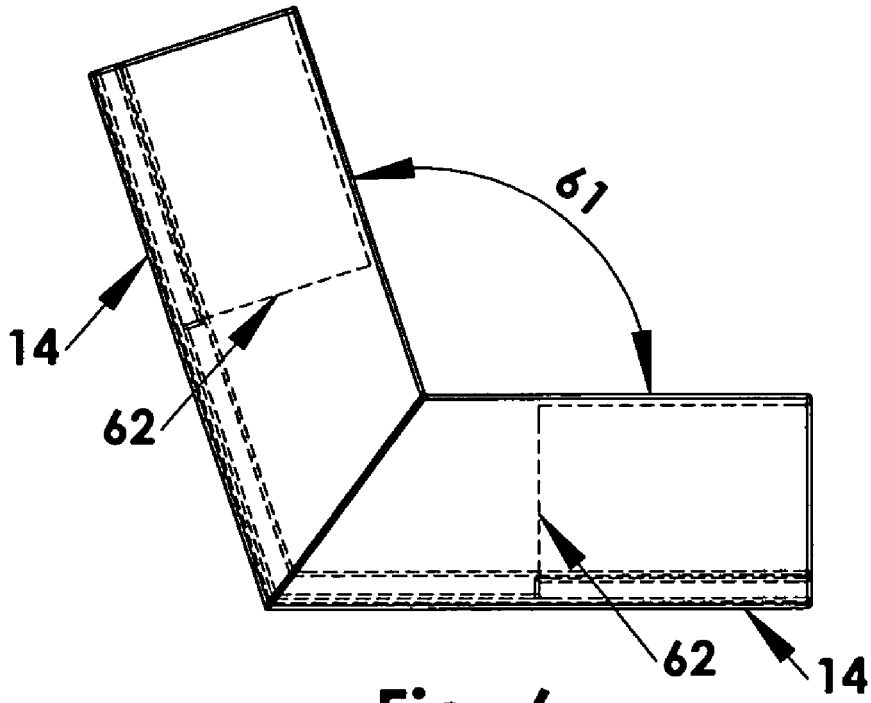
FIG. 6 is a top elevation view of a 108° pentagonal corner structure.

FIG. 6 shows the angular corner structure configured to a pentagonal angle 61 of 108° and when five of these angular corner structures are joined or combined with five equal individual lengths of FIG. 3 and pressed together as described in FIG. 4 a pentagonal picture frame is created. 62 shows an outline of the inner location of the abutment or stop which continues to the vertex corner 11*a*.

Figure 7:
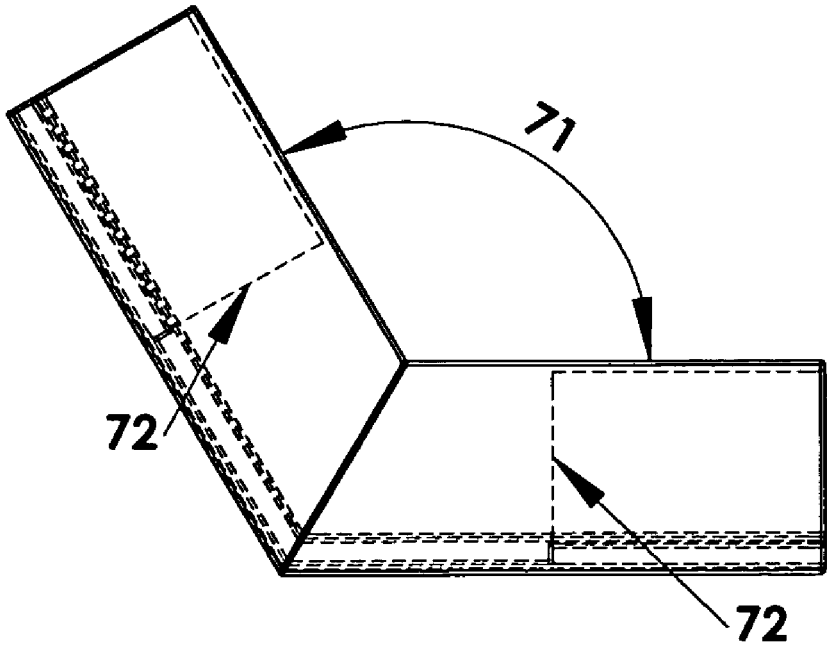
FIG. 7 is a top elevation view of a 120° hexagonal corner structure.

FIG. 7 shows the angular corner structure configured to a hexagonal angle 71 of 120° and when six of these angular corner structures are joined or combined with six equal individual lengths of FIG. 3 and pressed together as described in FIG. 4 a regular hexagonal picture frame is created. An irregular hexagonal frame is created by preferably lengthening any two opposing or parallel moulding lengths equally prior to assembly. 72 show 62 in this view.

Figure 8:
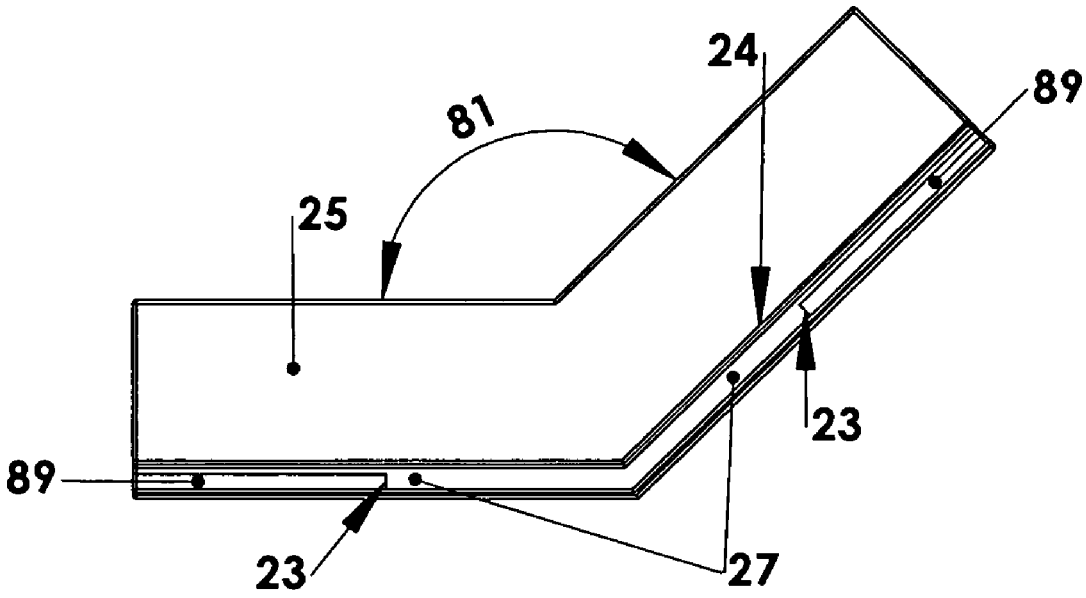
FIG. 8 is a bottom elevation view of a 135° octagonal corner structure.

FIG. 8 shows the angular corner structure configured to an octagonal angle 81 of 135° and when eight of these angular corner structures are joined or combined with eight equal individual lengths of FIG. 3 and pressed together as completed in FIG. 4 a regular octagonal frame is created. An irregular octagonal frame is created by preferably lengthening any two opposing or parallel moulding lengths equally prior to assembly. 89 shows a bottom view of hollow sleeve opening 19.

I claim:

1. Angular corner structures that join universal foldable frame moulding lengths comprising:

a. pre-formed polygon angles including triangular, rectangular, pentagonal, hexagonal, and octagonal;

b. an exterior side wall body structure in perpendicular intersection with an integral exterior lip body in perpendicular intersection with an integral lip edge body in perpendicular intersection with an integral inner lip body in perpendicular intersection with an integral inner side wall body;

c. a hollow perpendicular sleeve or slot or opening bordered by the exterior and inner side wall bodies and the exterior and inner lip bodies and the lip edge body and an integral abutment or stop and forms an interior rabbet or a recess or a shelf or a stop;

d. the integral abutment or stop terminates the sleeve and continues to an integral vertex corner;

e. the lip body, sleeve, side wall body, and other elements on each side of the integral vertex corner are identically duplicated on an adjoining integral vertex angular body including the lip body, sleeve, side wall body, and other elements.

2. Angular corner structures that join universal foldable frame moulding lengths as described in claim 1 comprising;

a. surfaces adorned or customized by the user with an assortment of color and design elements including painting, decaling, engraving, embossing, grooving, using an assortment of tools and techniques;

b. the abutment or stop the same thickness 0.045" as the sleeve and continues to the integral vertex corner;

c. the sleeve receives a factory end of the universal foldable frame moulding;

d. a plurality of thickness reduced score lines or grooves cut into the side wall bodies parallel to the perpendicular intersection between the lip body and the integral side wall body;

e. interior side wall body thickness reduced score lines or grooves cut at an off-set position from those cut into the exterior body in an equidistantly spaced pattern;

f. a body structure made using a resilient copolymer having the structural wall body thickness of 0.040".

3. Angular corner structures that join universal foldable frame moulding lengths as described in claims 1 and 2 comprising;

a. a temporarily assembled joint created by a friction force pressure applied by hand and is dismantled by a force of pulling the joint apart by hand;

b. a permanently assembled joint created by use of an adhesive or a solvent;

c. an adjustable depth/height side wall body using a blade or scissors and is cold-bent by use of hands;

d. a convertibility and customization to create a custom picture frame or a custom float frame and to create a regular or an irregular polygon shaped picture frame.

* * * * *